US011952754B2

(12) United States Patent
Redondo

(10) Patent No.: US 11,952,754 B2
(45) Date of Patent: Apr. 9, 2024

(54) BACKFLOW BOX AND METHOD

(71) Applicant: South Bay Plumbing, Inc., Jamul, CA (US)

(72) Inventor: Jorge Redondo, Jamul, CA (US)

(73) Assignee: SOUTH BAY PLUMBING, INC., Jamul, CA (US)

( * ) Notice: Subject to any disclaimer, the term of this patent is extended or adjusted under 35 U.S.C. 154(b) by 0 days.

(21) Appl. No.: 18/077,027

(22) Filed: Dec. 7, 2022

(65) Prior Publication Data

US 2023/0313509 A1 Oct. 5, 2023

Related U.S. Application Data

(60) Provisional application No. 63/327,267, filed on Apr. 4, 2022.

(51) Int. Cl.
*E03B 7/07* (2006.01)
*E03B 7/08* (2006.01)

(52) U.S. Cl.
CPC ..... *E03B 7/077* (2013.01); *E03B 7/08* (2013.01)

(58) Field of Classification Search
CPC ..... E03B 7/077; E03B 7/08; E03B 7/095
See application file for complete search history.

(56) References Cited

U.S. PATENT DOCUMENTS 3,862,433 A 1/1975 Rousselet
4,094,233 A 6/1978 Martin
4,726,394 A * 2/1988 Devine ..... F16K 27/12 137/550
4,890,638 A * 1/1990 Davenport ..... F16K 49/00 52/302.1
6,021,804 A * 2/2000 Griffin ..... F16L 53/38 137/341
6,079,439 A * 6/2000 Hartley ..... F16L 59/161 138/149
6,532,985 B1 * 3/2003 Griffin ..... E03B 7/095 137/341
7,880,641 B2 * 2/2011 Parris ..... G01F 15/185 700/282
8,910,654 B2 12/2014 Dawes
2002/0043490 A1 * 4/2002 Newman ..... E03B 7/08 210/97
2012/0234398 A1 * 9/2012 Leymann ..... E03B 7/08 137/15.05

(Continued)

FOREIGN PATENT DOCUMENTS

WO 2010103521 A3 9/2010

*Primary Examiner* — Reinaldo Sanchez-Medina
(74) *Attorney, Agent, or Firm* — PROCOPIO, CORY, HARGREAVES & SAVITCH LLP

(57) ABSTRACT

A method of using a backflow box with a water-using appliance comprising providing a backflow box including a backflow preventer and drainage; installing the backflow box in a wall cavity of a building in an accessible and viewable location; coupling the backflow preventer of the backflow box to a water supply and the water-using appliance; coupling the drainage of the backflow box to drain line of the building; inhibiting backflow from the water-using appliance from flowing into the water supply backflow preventer; and draining backflow through the drainage of the backflow box to the drain line of the building.

15 Claims, 3 Drawing Sheets

(56) References Cited

U.S. PATENT DOCUMENTS

| | | | | |
|---|---|---|---|---|
| 2013/0139923 | A1* | 6/2013 | Stokely | F16L 59/161 138/103 |
| 2017/0278372 | A1* | 9/2017 | Doughty | G01F 1/28 |
| 2018/0238029 | A1* | 8/2018 | Kuhbier | E03B 7/08 |
| 2021/0372095 | A1* | 12/2021 | Whitelaw | E03B 7/077 |

* cited by examiner

BACKFLOW BOX AND METHOD

FIELD OF THE INVENTION

The invention relates to back flow prevention devices for coffee makers, ice makers, soda fountains, and similar appliances where it is desirable to provide backflow prevention.

SUMMARY OF THE INVENTION

An aspect of the disclosure involves a method of using a backflow box with a water-using appliance comprising providing a backflow box including a backflow preventer and drainage; installing the backflow box in a wall cavity of a building in an accessible and viewable location; coupling the backflow preventer of the backflow box to a water supply and the water-using appliance; coupling the drainage of the backflow box to drain line of the building; inhibiting backflow from the water-using appliance from flowing into the water supply backflow preventer; and draining backflow through the drainage of the backflow box to the drain line of the building.

One or more implementations of the aspect of the disclosure described immediately above includes one or more of the following: installing the backflow box at least six inches above a flood rim; accessing the backflow box and observing drainage in case of backflow failure; the building is one of a house, an apartment, a condo, a residential building, a commercial building, a government building, and an industrial building; the water-using appliance is one of a coffee maker, an ice maker, and a soda fountain; the backflow box includes a plastic box housing; the backflow box includes a lateral support bracket that laterally supports and spaces the backflow preventer above the drainage; the backflow box includes a vertical support that vertically supports and spaces the backflow preventer above the drainage; the drainage of the backflow box includes an drain funnel spaced from the backflow preventer by an air gap; the backflow box includes backflow plumbing components coupled to the backflow preventer; the backflow plumbing components include a ball valve; the backflow plumbing components include a nipple drain; the backflow preventer is a check valve backflow preventer; and/or the backflow preventer is a dual check valve backflow preventer with atmospheric port and strainer.

Another aspect of the disclosure involves a backflow box for inhibiting backflow from a water-using appliance from flowing into a water supply line comprising a drainage in the backflow box; backflow preventer to inhibit backflow from a water-using appliance from flowing into a water supply line, and spaced above the drainage; and a backflow box housing that houses the drainage and backflow preventer.

One or more implementations of the aspect of the disclosure described immediately above includes one or more of the following: the backflow box housing is a plastic box housing; the backflow box includes a lateral support bracket that laterally supports and spaces the backflow preventer above the drainage; the backflow box includes a vertical support that vertically supports and spaces the backflow preventer above the drainage; the drainage of the backflow box includes an drain funnel spaced from the backflow preventer by an air gap; the backflow box includes backflow plumbing components coupled to the backflow preventer; the backflow plumbing components include a ball valve; the backflow plumbing components include a nipple drain; the backflow preventer is a check valve backflow preventer; and/or the backflow preventer is a dual check valve backflow preventer with atmospheric port and strainer.

DETAILED DESCRIPTION

Figure 1:
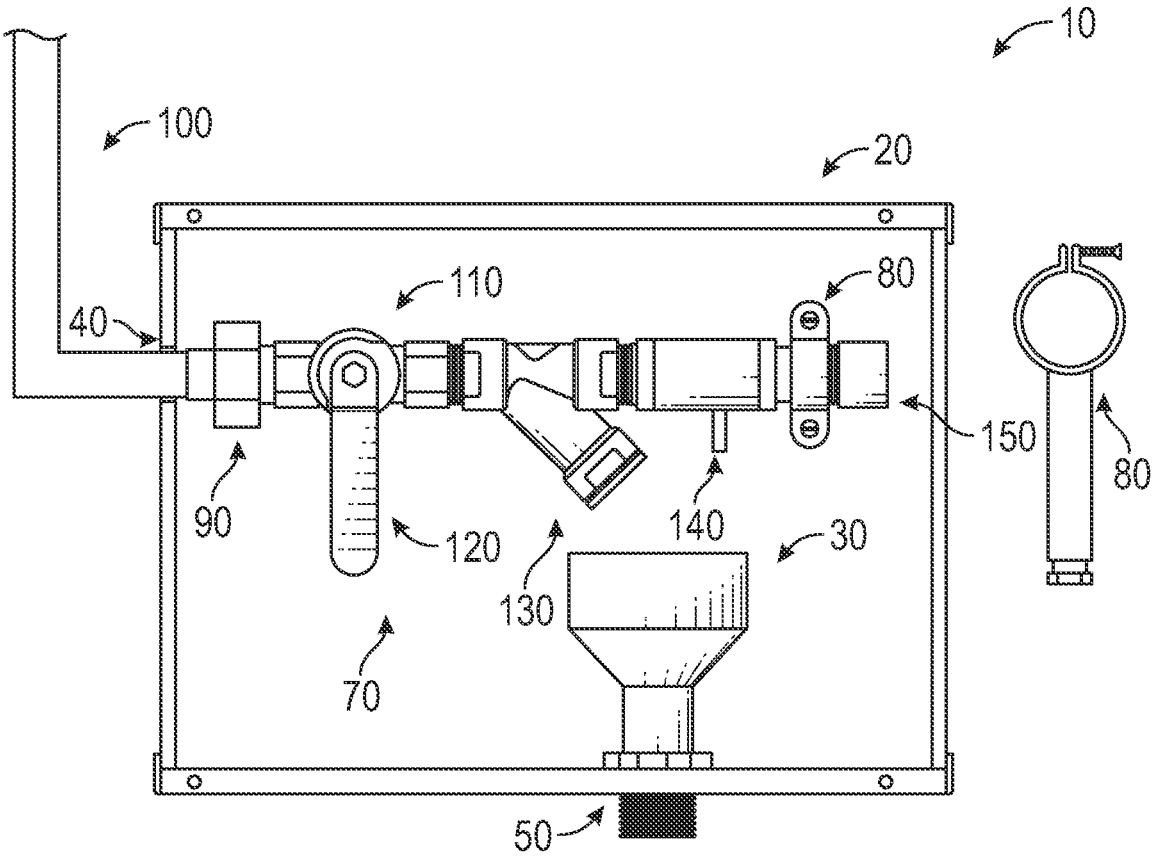
FIG. 1 is a partial cross-sectional and front elevational view of an embodiment of a backflow box.
Figure 2:
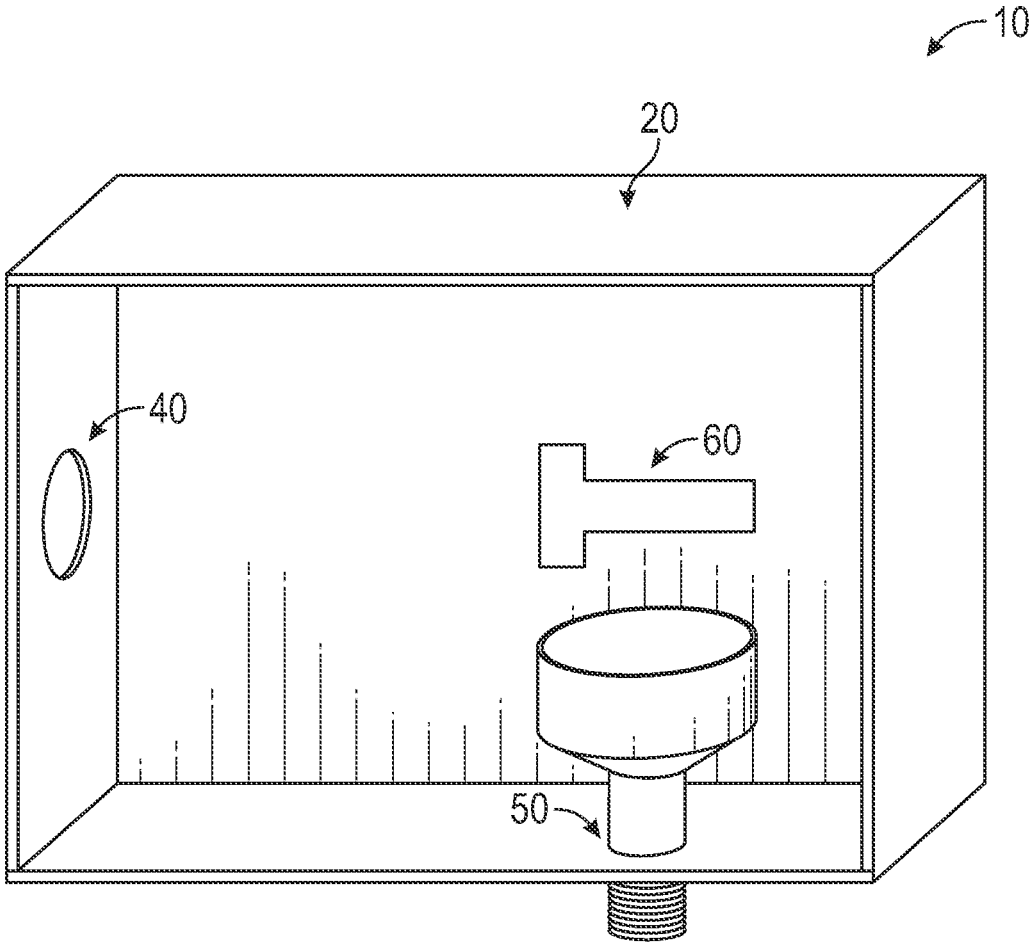
FIG. 2 is a perspective view of an inside of the backflow box of FIG. 1 with the plumbing removed.

With reference to FIGS. 1 and 2, an embodiment of a backflow box 10 for coffee makers, ice makers, soda fountains, and similar appliances where it is desirable to provide backflow prevention will be described.

The backflow box 10 includes a plastic box housing 20 that houses an integral drain/funnel/cup 30, which leads to wye branch under sink, a water supply line opening 40, a drain opening 50, a lateral/horizontal support/support bracket mounting opening 60, backflow plumbing components 70, a support/support bracket 80 that supports the backflow plumbing components 70, in their correct position, inside the box housing 20. The backflow plumbing components 70 include a union 90 that couples to a copper feed 100, a ball valve 110 with ball valve handle 120, a ⅜ inch dual check valve backflow preventer with atmospheric port and strainer ("backflow preventer") 130, a brass nipple drain 140, and connector 150, which connects to coffee maker, ice maker, soda fountain, or similar appliance. The plastic box housing 20 may be rectilinear, curvilinear, a combination of rectilinear and curvilinear, and/or have another configuration other than traditional flat base/sides/square/rectangular.

The backflow box 10 will now be described in use. The backflow box 10 installed recessed in wall cavity in an accessible and viewable location, minimum 6" above flood rim of drain line. The backflow box 10 is designed to accept the ⅜ inch dual check valve backflow preventer with atmospheric port and strainer 130. When correctly installed, the backflow preventer 130 is viewable to provide visual indication of drainage in case of backflow failure. In the case of backflow failure, the provided air gap drain funnel routes the water to an under-sink location for connection to building drainage.

Figure 3:
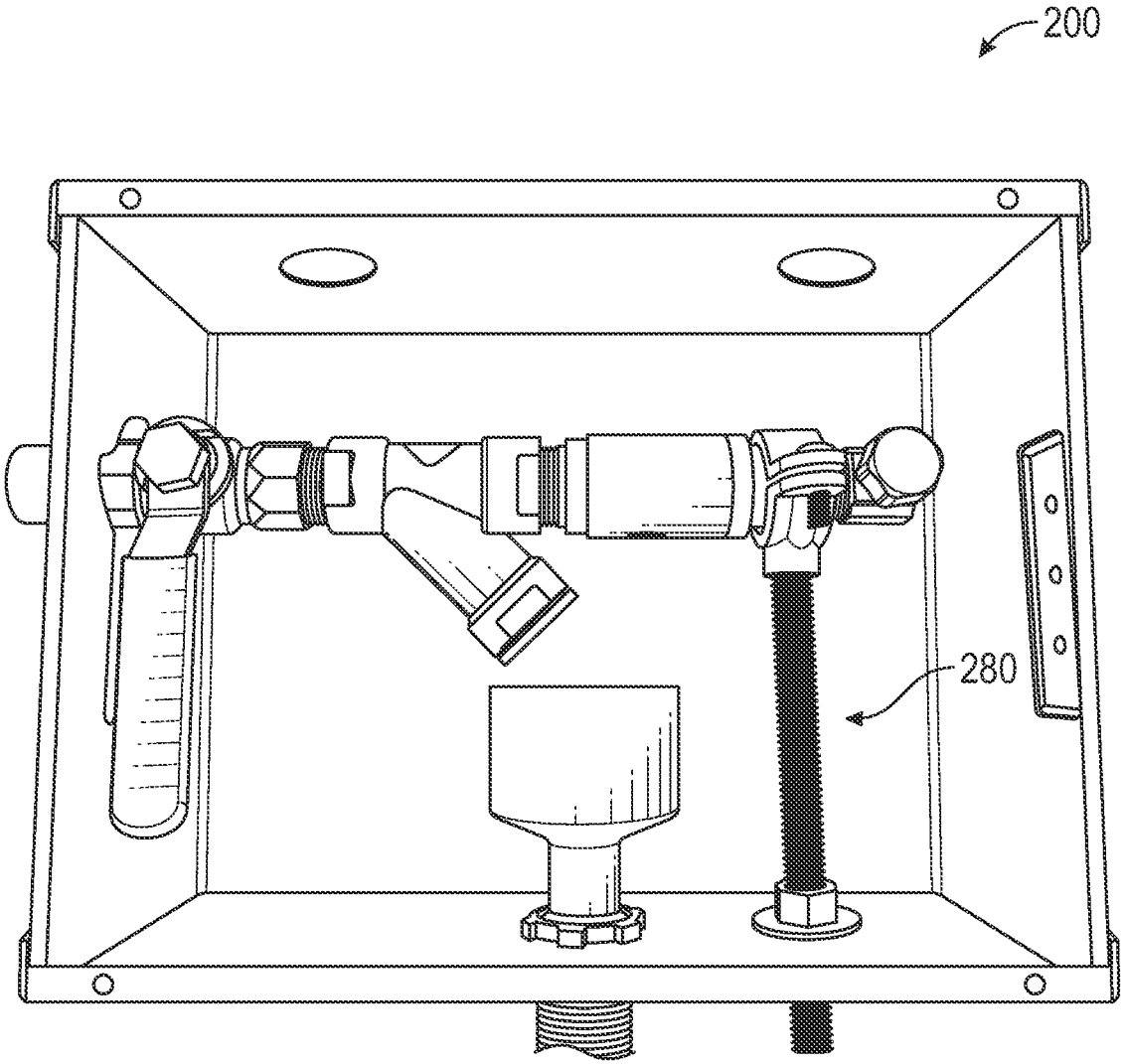
FIG. 3 is a partial cross-sectional and front elevational view of another embodiment of a backflow box.

With reference to FIG. 3, another embodiment of a backflow box 200 is shown. The backflow box 200 is similar to the backflow box 10, but instead of a lateral/horizontal support 80, the backflow box 200 includes a vertical support 280.

While various embodiments of the present invention have been described above, it should be understood that they have been presented by way of example only, and not of limitation. Likewise, the various diagrams may depict an example architectural or other configuration for the disclosure, which is done to aid in understanding the features and functionality that can be included in the disclosure. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present disclosure.

Although the disclosure is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosure, whether or not such embodiments are described and whether or not such features are presented as being a part of a described embodiment. Thus, the breadth and scope of the present disclosure should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent.

The invention claimed is:

1. A method of using a backflow box with a water-using appliance, comprising: providing a backflow box including a plurality of backflow plumbing components for water supply flow, the plurality of backflow plumbing components including a backflow preventer including a drainage outlet, a nipple drain, and a plumbing outlet that the water supply flows out of the backflow box from, the plumbing outlet, the nipple drain, and the drainage outlet all being separate, and the backflow box including a drainage spaced vertically below the nipple drain and the drainage outlet; installing the backflow box in a wall cavity of a building in an accessible and viewable location; coupling the backflow preventer of the backflow box to a water supply line and the water-using appliance; coupling the drainage of the backflow box to a drain line of the building; inhibiting backflow from the water-using appliance from flowing into the water supply line with the backflow preventer; draining backflow through the drainage of the backflow box to the drain line of the building.

2. The method of claim 1, further including installing the backflow box at least six inches above a flood rim.

3. The method of claim 1, further including accessing the backflow box and observing drainage in case of backflow failure.

4. The method of claim 1, wherein the building is one of a house, an apartment, a condo, a residential building, a commercial building, a government building, and an industrial building.

5. The method of claim 1, wherein the water-using appliance is one of a coffee maker, an ice maker, and a soda fountain.

6. The method of claim 1, wherein the backflow box includes a plastic box housing.

7. The method of claim 1, wherein the backflow box includes a lateral support bracket that laterally supports and spaces the backflow preventer above the drainage.

8. The method of claim 1, wherein the backflow box includes a vertical support that vertically supports and spaces the backflow preventer above the drainage.

9. The method of claim 1, wherein the drainage of the backflow box includes an drain funnel spaced from the backflow preventer by an air gap.

10. The method of claim 1, wherein the backflow box includes backflow plumbing components coupled to the backflow preventer.

11. The method of claim 10, wherein the backflow plumbing components include a ball valve.

12. The method of claim 1, wherein the backflow preventer is a check valve backflow preventer.

13. The method of claim 1, wherein the backflow preventer is a dual check valve backflow preventer with atmospheric port and strainer.

14. A method of using a backflow box with a water-using appliance, comprising: providing a backflow box including a plurality of backflow plumbing components for water supply flow, the plurality of backflow plumbing components including a backflow preventer including a drainage outlet, a nipple drain, and a plumbing outlet that the water supply flows out of the backflow box from, the plumbing outlet, the nipple drain, and the drainage outlet all being separate, and the backflow box including a drainage; installing the backflow box in a wall cavity of a building in an accessible and viewable location; coupling the backflow preventer of the backflow box to a water supply line and the water-using appliance; coupling the drainage of the backflow box to a drain line of the building; inhibiting backflow from the water-using appliance from flowing into the water supply line with the backflow preventer; draining backflow through the drainage of the backflow box to the drain line of the building.

15. A method of using a backflow box with a water-using appliance, comprising: providing a backflow box including a plurality of backflow plumbing components for water supply flow, the plurality of backflow plumbing components including a backflow preventer including a drainage outlet, and a plumbing outlet that the water supply flows out of the backflow box from, the plumbing outlet separate from the drainage outlet, and a drainage; installing the backflow box in a wall cavity of a building in an accessible and viewable location; coupling the backflow preventer of the backflow box to a water supply line and the water-using appliance; coupling the drainage of the backflow box to a drain line of the building; inhibiting backflow from the water-using appliance from flowing into the water supply line with the backflow preventer; draining backflow through the drainage of the backflow box to the drain line of the building.

* * * * *